US007673981B2

(12) United States Patent
Matsuyama

(10) Patent No.: US 7,673,981 B2
(45) Date of Patent: Mar. 9, 2010

(54) IMAGE FORMATION APPARATUS

(75) Inventor: Kengo Matsuyama, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 723 days.

(21) Appl. No.: 11/371,816

(22) Filed: Mar. 8, 2006

(65) Prior Publication Data

US 2006/0203066 A1 Sep. 14, 2006

(30) Foreign Application Priority Data

Mar. 8, 2005 (JP) ..... 2005-064292

(51) Int. Cl.

| | |
|---|---|
| ***B41J 2/01*** | (2006.01) |
| ***B41J 2/385*** | (2006.01) |
| ***B41J 2/435*** | (2006.01) |
| ***B41J 2/455*** | (2006.01) |
| ***G03G 13/04*** | (2006.01) |
| ***H01J 29/70*** | (2006.01) |
| ***H01J 33/00*** | (2006.01) |

(52) U.S. Cl. ..... 347/103; 347/129; 347/229; 347/233

(58) Field of Classification Search ..... 347/103, 347/130, 132, 139, 228, 229, 233, 234, 238, 347/241, 248, 129, 140

See application file for complete search history.

(56) References Cited

U.S. PATENT DOCUMENTS

| | | | | |
|---|---|---|---|---|
| 4,803,515 | A * | 2/1989 | Hoshino et al. | 399/299 |
| 5,083,141 | A * | 1/1992 | Taguchi et al. | 347/261 |
| 5,285,221 | A * | 2/1994 | Sumiyoshi et al. | 347/119 |
| 5,469,248 | A * | 11/1995 | Fujiwara et al. | 399/314 |
| 5,515,154 | A * | 5/1996 | Hasegawa et al. | 399/303 |
| 5,574,550 | A * | 11/1996 | Okazaki et al. | 399/313 |
| 5,631,726 | A * | 5/1997 | Sawada | 399/111 |
| 6,580,443 | B2 * | 6/2003 | Yamaguchi et al. | 347/115 |
| 6,701,117 | B2 * | 3/2004 | Kaji | 399/301 |
| 6,907,212 | B2 * | 6/2005 | Harada et al. | 399/167 |
| 6,949,896 | B2 * | 9/2005 | Andoh et al. | 318/135 |
| 7,345,695 | B2 * | 3/2008 | Suzuki | 347/235 |
| 2003/0128999 | A1 * | 7/2003 | Bessho et al. | 399/121 |
| 2004/0155949 | A1 * | 8/2004 | Masuda | 347/115 |

FOREIGN PATENT DOCUMENTS

| | | | |
|---|---|---|---|
| JP | 04-149478 | | 5/1992 |
| JP | 09244327 | A * | 9/1997 |
| JP | 2002-014507 | | 1/2002 |
| JP | 2003-177588 | A | 6/2003 |

* cited by examiner

*Primary Examiner*—Manish S Shah
*Assistant Examiner*—Leonard S Liang
(74) *Attorney, Agent, or Firm*—Edwards Angell Palmer & Dodge LLP; David G. Conlin; David A. Tucker

(57) ABSTRACT

An image formation apparatus with a plurality of laser diodes that form color-component images, which correspond to a plurality of color components, onto a plurality of corresponding photosensitive drums respectively, and a transfer belt onto which the color-component images that are formed on the respective photosensitive drums are transferred. The image formation apparatus adjusts the image formation timing based on the positions of the color-component images that are transferred to the transfer belt; and when adjusting the image formation timing, the respective laser diodes form color-component images at formation intervals that correspond to an integral multiple of the period of a periodic noise.

7 Claims, 12 Drawing Sheets

FIG. 5A

| INTEGRAL MULTIPLE n | MARK PITCH (DOTS) |
|---|---|
| 1 | 18.55 |
| 2 | 37.10 |
| 3 | 55.65 |
| 4 | 74.20 |
| 5 | 92.75 |
| 6 | 111.30 |
| 7 | 129.85 |
| 8 | 148.40 |
| 9 | 166.95 |
| 10 | 185.50 |
| 11 | 204.05 |
| 12 | 222.60 |
| 13 | 241.15 |
| 14 | 259.70 |
| 15 | 278.25 |
| 16 | 296.80 |
| 17 | 315.35 |
| 18 | 333.90 |
| 19 | 352.45 |
| 20 | 371.00 |
| 21 | 389.55 |
| 22 | 408.10 |
| 23 | 426.65 |
| 24 | 445.20 |
| 25 | 463.75 |

FIG. 5B n=4.74.2 DOTS

| POSITION OF STARTING DOT | MARK PITCH (DOTS) |
|---|---|
| 1 | |
| 75 | 74 |
| 149 | 74 |
| 223 | 74 |
| 297 | 74 |
| 372 | 75 |
| 446 | 74 |
| 520 | 74 |
| 594 | 74 |
| 668 | 74 |
| 743 | 75 |
| 817 | 74 |
| 891 | 74 |

IMAGE FORMATION APPARATUS

CROSS-REFERENCE TO RELATED APPLICATIONS

This Non-provisional application claims priority under 35 U.S.C. §119(a) on Patent Application No. 2005-64292 filed in Japan on Mar. 8, 2005, the entire contents of which are hereby incorporated by reference.

BACKGROUND OF THE INVENTION

This invention relates to an image formation apparatus comprising: image formation means for forming color-component images corresponding to a plurality of color components onto a plurality of image-carrying bodies respectively that correspond to the respective color components; and a transfer medium onto which the respective color components formed on the image-carrying bodies are transferred; and adjusts the timing for forming an image based on the positions of the respective color-component images that are transferred to the transfer medium.

There are image formation apparatuses for forming color images on paper that form color-component images onto respective photosensitive drums for black, cyan, magenta and yellow, for example, and then transfer and overlay the images onto a transfer belt. Formation of the color-component images onto each of the respective photosensitive drums is performed by using a plurality of polygon mirrors that correspond to the respective photosensitive drums to reflect laser beams that are outputted from a plurality of laser diodes that correspond to the respective photosensitive drums, and irradiate the respective beams onto the respective photosensitive drums. There are also apparatuses in which the number of polygon mirrors is reduced, and irradiate laser beams from a plurality of laser diodes onto a common polygon mirror, and irradiate the respective laser beams reflected by the polygon mirror onto the respective corresponding photosensitive drums.

In these kinds of image formation apparatuses, there is a problem in that there is a decrease in image quality due to position shift of the color-component images that are transferred to the transfer belt. Therefore, images (hereafter referred to as a marks) are formed for adjusting the image formation timing, and the position of the formed marks is detected and image formation timing is adjusted based on the detected position of the marks (for example, refer to Japanese Patent Application Laid-Open No. 4-149478 (1992)).

BRIEF SUMMARY OF THE INVENTION

The timing for forming the marks is set mainly by the timing for outputting the laser beams, however, there is a problem in that misalignment of the formation position of the marks occurs due to fluctuation in the rpm of the photosensitive drums. Also, when forming each of the marks, the surface of the polygon mirrors that reflect the laser beams is not constant, so there is a problem in that misalignment of the formation position of the marks occurs due to differences in the reflection surface. Noise that occurs due to fluctuations in rpm of the photosensitive drums, and differences in the reflection surface of the polygon mirrors is often periodic.

Taking into consideration the aforementioned circumstances, it is an object of this invention to provide an image formation apparatus that, when adjusting the timing of image formation, is capable of making the noise that affects formed color-component images uniform by forming the color-component images at formation intervals that correspond to an integral multiple of the period of a periodic noise.

Also, another object of the present invention is to provide an image formation apparatus that is capable of making the noise from the gears of an image-carrying body uniform by making the aforementioned formation interval correspond to an integral multiple of the tooth interval of the gears of the image-carrying body.

Moreover, another object of the present invention is to provide an image formation apparatus that is capable of preventing an accumulation of the error between the formation interval and the integral multiple of the noise period by changing the aforementioned formation interval after each specified period.

Furthermore, another object of the present invention is to provide an image formation apparatus that is capable of making the noise related to the polygon mirror uniform by making the aforementioned formation interval correspond to an integral multiple of the number of surfaces of the polygon mirror.

Also, another object of the present invention is to provide an image formation apparatus that, when adjusting the image formation timing, is capable of making the noise that affects the detection of the position of the front end and rear end of the formed color-component images uniform by forming the length of the color-component images in the direction of the formation interval, a length that corresponds to an integral multiple of the number of surfaces of the polygon mirror+1.

Moreover, another object of the present invention is to provide an image formation apparatus that, when adjusting the image formation timing, is capable of reducing the effect of position misalignment that occurs when forming all of the color-component images on the transfer medium by forming each of the color-component images on each of the respective image-carrying bodies at the same timing.

The image formation apparatus of this invention comprises: image formation means for forming color-component images that correspond to a plurality of color components onto a plurality of corresponding image-carrying bodies respectively; and a transfer medium onto which the respective color-component images that are formed on the image-carrying bodies are transferred; and where the image formation apparatus adjusts the image formation timing based on the positions of the respective color-component images that are transferred to the transfer medium; and when adjusting the image formation timing, the image formation means forms color-component images at formation intervals that correspond to an integral multiple of the period of a periodic noise. In this invention, when adjusting the image formation timing, the image formation means forms color-component images at formation intervals that correspond to an integral multiple of the period of a periodic noise, so the noise affecting the formed color-component images becomes uniform. Therefore, by taking into consideration noise, it is possible to adjust the image formation timing with high precision.

The image formation apparatus of this invention comprises: image formation means for forming color-component images that correspond to a plurality of color components onto a plurality of corresponding image-carrying bodies respectively; and a transfer medium onto which the respective color-component images that are formed on the image-carrying bodies are transferred; and where the image formation apparatus adjusts the image formation timing based on the positions of the respective color-component images that are transferred to the transfer medium; and the image-carrying bodies comprise gears to which a rotational movement is transferred; and when adjusting the image formation timing, the image formation means forms color-component images at formation intervals that correspond to an integral multiple of the tooth interval of the gears. In this invention, the image-carrying bodies comprise gears to which a rotational movement is transferred, and due to the tolerance and play between tooth of gears, periodic noise having a period that corresponds to the tooth interval of the gears affects the formation of color-component images, however, since the aforementioned formation interval corresponds to an integral multiple of the tooth interval of the gears, the noise affecting the formed color-component images becomes uniform. The noise from the gears of the image-carrying bodies can be made uniform, so by taking that noise into consideration, it is possible to adjust the image formation timing with high precision.

The image formation apparatus of this invention is constructed such that the image formation means changes the formation interval after each specified period. In this invention, the image formation means changes the formation interval after each specified period, so even when the aforementioned formation interval does not perfectly match the period of the periodic noise, it is still possible to prevent an accumulation of error. For example, when the formation interval is 4.1 times the periodic interval A of the noise, then normally the integral multiple is set to 4 times, and after every 10 periods, it is possible to substitute 5 times as the integral multiple in the place of 4 times ($4\Delta\times9+5\Delta=41\Delta=4.1\Delta\times10$). In this way, together with being able to flexibly set the formation interval, it is possible to prevent error between the formation interval and the integral multiple of the period of the noise from accumulating.

The image formation apparatus of this invention comprises: image formation means for forming color-component images that correspond to a plurality of color components onto a plurality of corresponding image-carrying bodies respectively; and a transfer medium onto which the respective color-component images that are formed on the image-carrying bodies are transferred; and where the image formation apparatus adjusts the image formation timing based on the positions of the respective color-component images that are transferred to the transfer medium; and the image formation means comprises a polygon mirror and an irradiation unit that irradiates light beams onto the polygon mirror, and is constructed such that the light beams that are reflected by the polygon mirror are irradiated onto the image-carrying bodies; and when adjusting the image formation timing, the image formation means forms the color-component images at formation intervals that correspond to an integral multiple of the number of surfaces of the polygon mirror. In this invention, the image formation means comprises a polygon mirror and an irradiation unit that irradiates light beams onto the polygon mirror, so the individual difference between each of the surfaces of the polygon mirror causes periodic noise having a period that corresponds to the number of surfaces of the polygon mirror, and this noise affects the formation of color-component images, however, since the aforementioned formation interval is an interval that corresponds to an integral multiple of the number of surfaces of the polygon mirror, the noise affecting the formed color-component images becomes uniform. The noise from the polygon mirror can be made uniform, so by taking this noise into consideration, it is possible to adjust the image formation timing with high precision.

The image formation apparatus of this invention is constructed such that when adjusting the image formation timing, the image formation means forms color-component images having a length in the formation-interval direction that corresponds to an integral multiple of the number of surfaces of the polygon mirror+1. In this invention, when adjusting the image formation timing, the image formation means forms color-component images having a length in the formation-interval direction that corresponds to an integral multiple of the number of surfaces of the polygon mirror+1, so the surface of the polygon mirror that corresponds to the front end and rear end of a formed color-component image is the same surface, and the noise that affects those front and rear ends is made uniform. Therefore, by taking this noise into consideration, it is possible to adjust the image formation timing with high precision. The formation position of a color-component image can be detected by detecting just the position of the front end of the color-component image, however, the method of detecting the positions of both the front and rear ends and finding the average improves the precision of position detection.

The image formation apparatus of this invention is constructed such that when adjusting the image formation timing, the image formation means forms each of the color-component images onto the respective image-carrying bodies at the same timing. In this invention, when adjusting the image formation timing, the image formation means forms each of the color-component images onto the respective image-carrying bodies at the same timing, so transferring the respective color-component images to the transfer medium is also performed at the same timing. In this case, the interval between each of the color-component images that are formed on the transfer medium becomes the same as the interval between each of the respective image-carrying bodies. When compared with a method of forming each of the color-component images on the respective image-carrying bodies at different timing, this method makes it possible to decrease the effect of position shifts that occur when forming all of the color-component images onto the transfer medium, and makes it possible to adjust the image formation timing with high precision.

The above and further objects and features of the invention will be more fully apparent from the following detailed description with accompanying drawings.

BRIEF DESCRIPTION OF THE SEVERAL VIEWS OF THE DRAWINGS

FIG. 5A is a concept drawing showing an example of mark pitch candidates;

FIG. 5B is a concept drawing showing another example of mark formation;

DETAILED DESCRIPTION OF THE INVENTION

The present invention will be described in detail below based on drawings showing the preferred embodiments.

Figure 1:
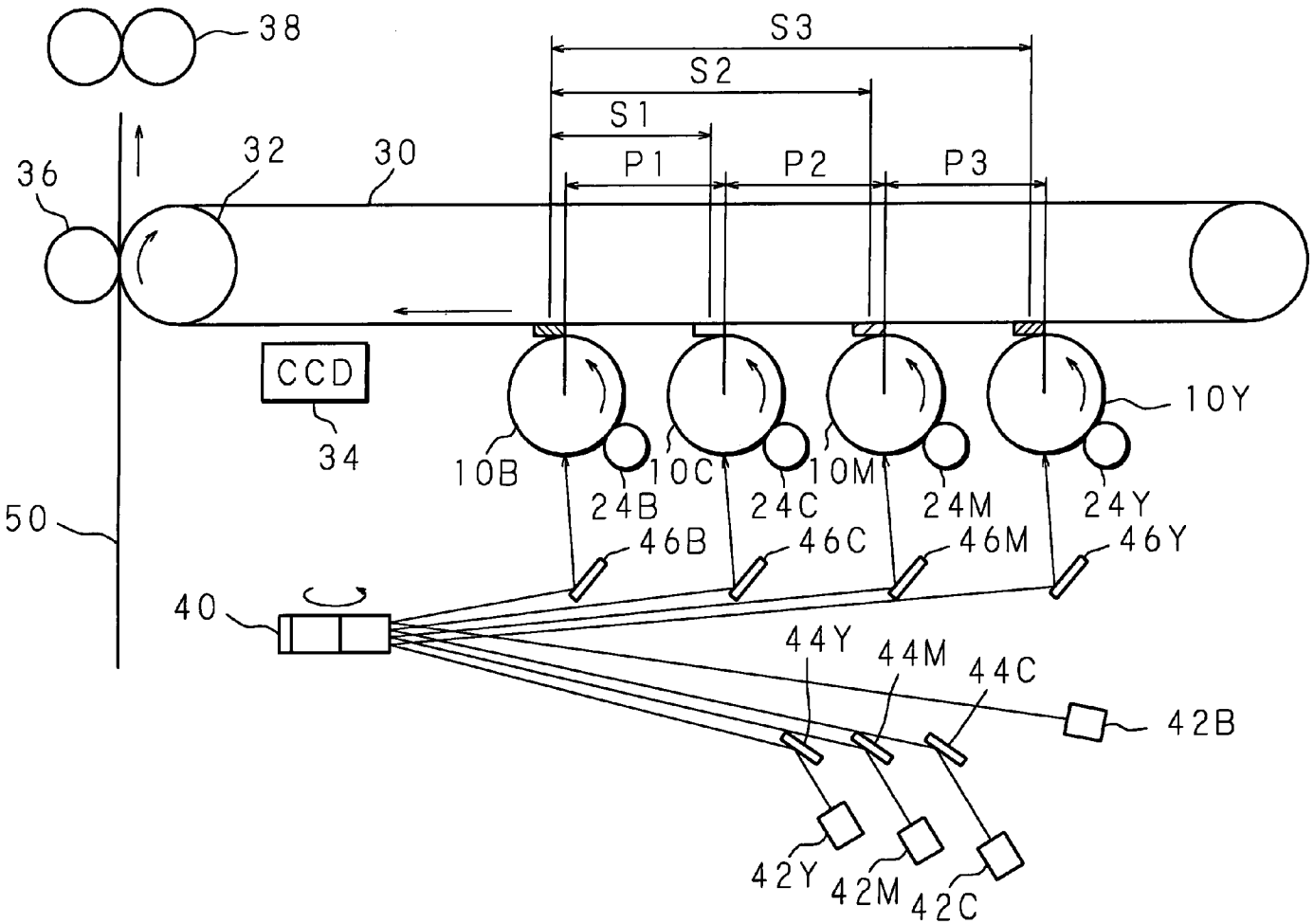
FIG. 1 is a drawing showing the major parts of the image formation apparatus of the present invention.

FIG. 1 is a drawing showing the major parts of the image formation apparatus of the invention. The image formation apparatus comprises as major components: photosensitive drums (image-carrying bodies) on which images are formed; laser diodes (irradiation means) that output laser beams (light beams); first mirrors, polygon mirror 40 and second mirrors that direct the laser beams that are outputted from the laser diodes to the photosensitive drums; developer rollers that develop the latent images that are formed on the photosensitive drums by laser beams; and a transfer belt (transfer medium) 30 onto which the images formed on the photosensitive drums are transferred.

The photosensitive drums include a photosensitive drum 10B for black, a photosensitive drum 10C for cyan, a photosensitive drum 10M for magenta and a photosensitive drum 10Y for yellow. Similarly, the developer rollers include a developer roller 24B for black, a developer roller 24C for cyan, a developer roller 24M for magenta and a developer roller 24Y for yellow. Moreover, the laser diodes include a laser diode 42B for black, a laser diode 42C for cyan, a laser diode 42M for magenta and a laser diode 42Y for yellow.

The first mirrors include a first mirror 44C for cyan, a first mirror 44M for magenta and a first mirror 44Y for yellow that direct the laser beams that are respectively outputted from the laser diode 42C for cyan, the laser diode 42M for magenta and laser diode 42Y for yellow to the polygon mirror 40. Also, the second mirrors include a second mirror 46B for black, a second mirror 46C for cyan, a second mirror 46M for magenta and a second mirror 46Y for yellow that direct the laser beams that are reflected by the polygon mirror 40 to the photosensitive drum 10B for black, the photosensitive 10C for cyan, the photosensitive drum 10M for magenta and the photosensitive drum 10Y for yellow. By combining a plurality of mirrors in this way, it is possible to bring the irradiated positions (beam spots) of the laser beams that are irradiated from a plurality of separated laser diodes close together, and to irradiate the laser beams onto the same reflection surface of the polygon mirror 40.

The transfer belt 30 is loop shaped, and the photosensitive drums 10B, 10C, 10M, 10Y for each of the color components are arranged in a row so that they face the surface of the transfer belt 30. Also, the images that are transferred to the transfer belt 30 are moved by a belt-drive roller 32, which comes in contact with the transfer belt 30 on the inside of the loop, in the direction from right to left in the drawing with respect to the photosensitive drums. Moreover, a CCD (Charge Coupled Device) 34 is arranged so that it faces the surface of the transfer belt 30. The CCD 34 is located further in the direction of movement of the belt than the photosensitive drums. Also, the photosensitive drums are located in the order photosensitive drum 10B for black, photosensitive drum 10C for cyan, photosensitive drum 10M for magenta and photosensitive drum 10Y for yellow, going from the CCD 34 in the direction opposite the direction of belt movement.

Also, a transfer roller 36 is located so that the transfer belt 30 is located between it and the belt-drive roller 32, and so that it faces the belt-drive roller 32, and the image is transferred from the transfer belt 30 to paper 50 that passes the transfer roller 36 and fixed by a fixing roller 38.

Figure 2:
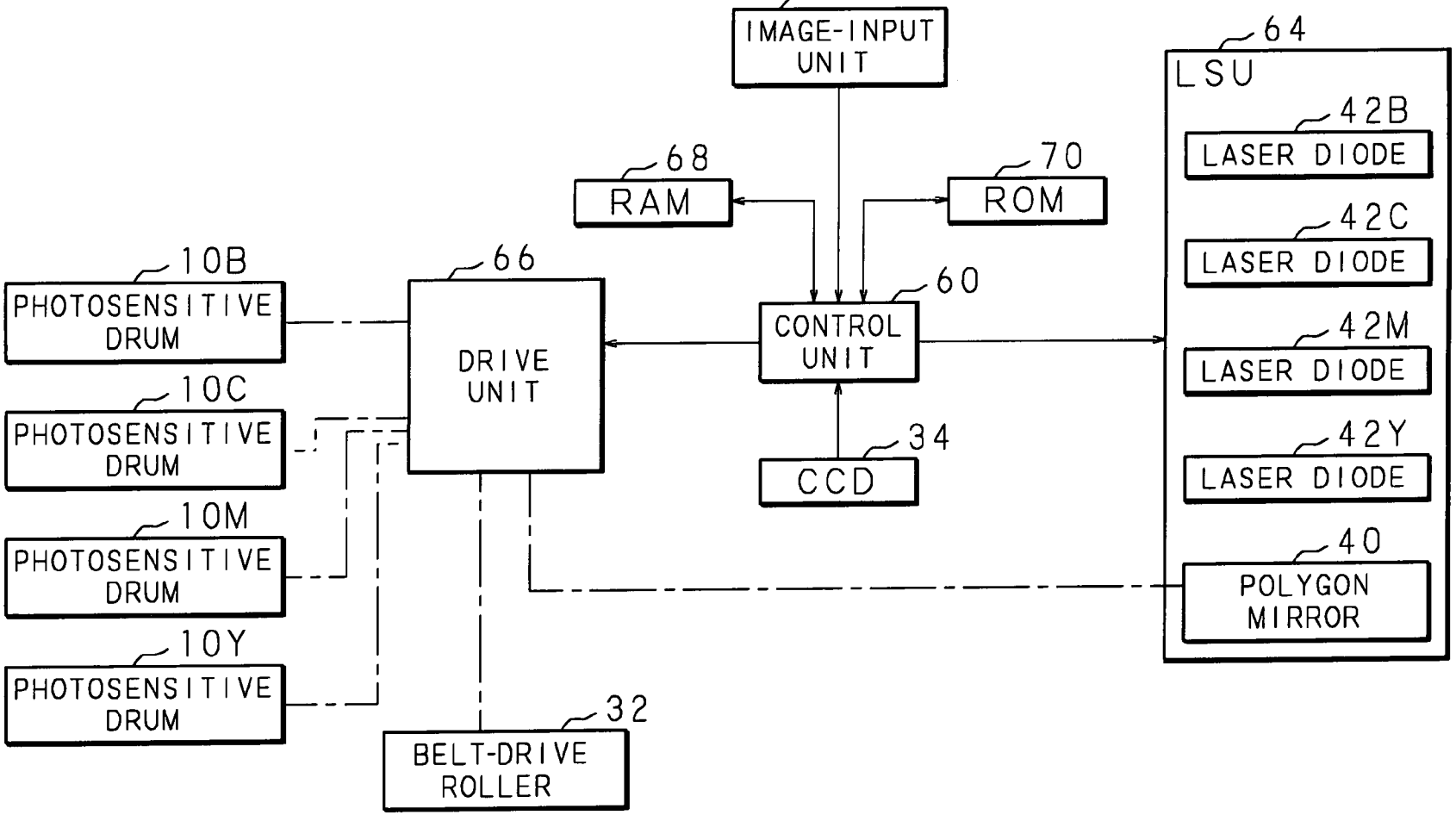
FIG. 2 is a block diagram showing the major parts of the image formation apparatus.

FIG. 2 is a block diagram showing the major construction of the image formation apparatus. The image formation apparatus comprises: a LSU (Laser Scanning Unit) 64 that includes the laser diodes 42B, 42C, 42M, 42Y, and the polygon mirror 40; the CCD 34 that detects the images (hereafter referred to as marks) for adjusting the image formation timing; the photosensitive drums 10B, 10C, 10M and 10Y; a drive unit 66 that drives the belt-drive roller 32 and polygon mirror 40; an image-input unit 62 such as an image scanner that reads an image from an original document; a control unit 60 such as a CPU (Central Processing Unit) that is connected to the CCD 34, LSU 64, drive unit 66 and image-input unit 62 described above; and RAM 68 and ROM 70 that are connected to the control unit 60. The control unit 60 performs control of all of the components inside the apparatus based on a program and data that are stored in ROM 70.

Figure 3:
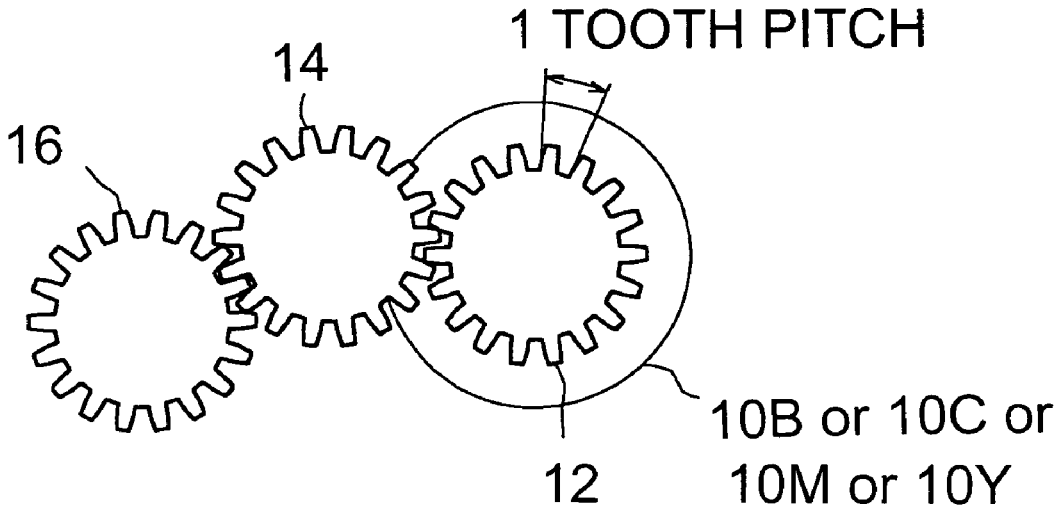
FIG. 3 is a drawing showing an example of the construction of the drive portion of a photosensitive drum.

The drive unit 66 comprises motors that drive each of the photosensitive drums 10B, 10C, 10M and 10Y, a motor that drives the polygon mirror 40 and a motor that drives the belt-drive roller 32. FIG. 3 is a drawing showing an example of the construction of the drive portion of each photosensitive drum 10B or 10C or 10M or 10Y. Each photosensitive drum comprises a photosensitive gear 12 that has the same center of rotation as its associated photosensitive drum, an idling gear 14 that engages with the photosensitive gear 12, and a motor gear 16 that is driven by the motor of the drive unit 66. The construction of the drive portion of each the color-component photosensitive drums 10B, 10C, 10M and 10Y is the same.

The LSU 64 operates as an image formation means for forming a black reference mark as a reference, and cyan, magenta and yellow adjustment marks, which are the to be adjusted, onto respective photosensitive drums corresponding to color components; the CCD 34 operates as a position-detection means for detecting the positions of the respective marks that are transferred to the transfer belt 30, and the control unit 60 controls the LSU 64 and adjusts the image formation timing based on the reference marks in order to do away with any difference between the detected positions and regulated positions of the respective adjustment marks.

When adjusting the image formation timing, the LSU 64, according to control from the control unit 60, causes each of the laser diodes 42 to emit light so that the respective adjustment marks are formed on the respective photosensitive drums 10B, 10C, 10M and 10Y at the same timing, and the laser beams for each of the colors that are irradiated from the respective laser diodes onto the same reflection surface of the polygon mirror 40 are reflected onto the respective photosensitive drums. Therefore, as shown in FIG. 1, the black, cyan, magenta and yellow marks are transferred to the transfer belt 30 at the same timing. In this case, the interval between each of the marks transferred onto the transfer belt 30 is the same as the interval of the photosensitive drums.

The control unit 60 adjusts the formation timing for cyan so that the interval S1 between the reference mark (black) and cyan adjustment mark is the same as the interval P1 between the black photosensitive drum 10B and the cyan photosensitive drum 10C. Similarly, the control unit 60 adjusts the formation timing for magenta so that the interval S2 between the reference mark (black) and magenta adjustment mark is the same as the interval (P1+P2) between the black photosensitive drum 10B and the magenta photosensitive drum 10M. Moreover, the control unit 60 adjusts the formation timing for yellow so that the interval S3 between the reference mark (black) and yellow adjustment mark is the same as the interval (P1+P2+P3) between the black photosensitive drum 10B and the yellow photosensitive drum 10Y.

Here, the control unit 60 finds the average value between the front-end position and the rear-end position in the direction of movement of the marks detected by the CCD 34 for the positions of the respective color-component images, and stores that value in RAM 68, and uses the stored average values as the positions of the marks. Here, the position of a mark is expressed by a dot position corresponding to the time the mark is detected by the CCD 34.

Figure 12:
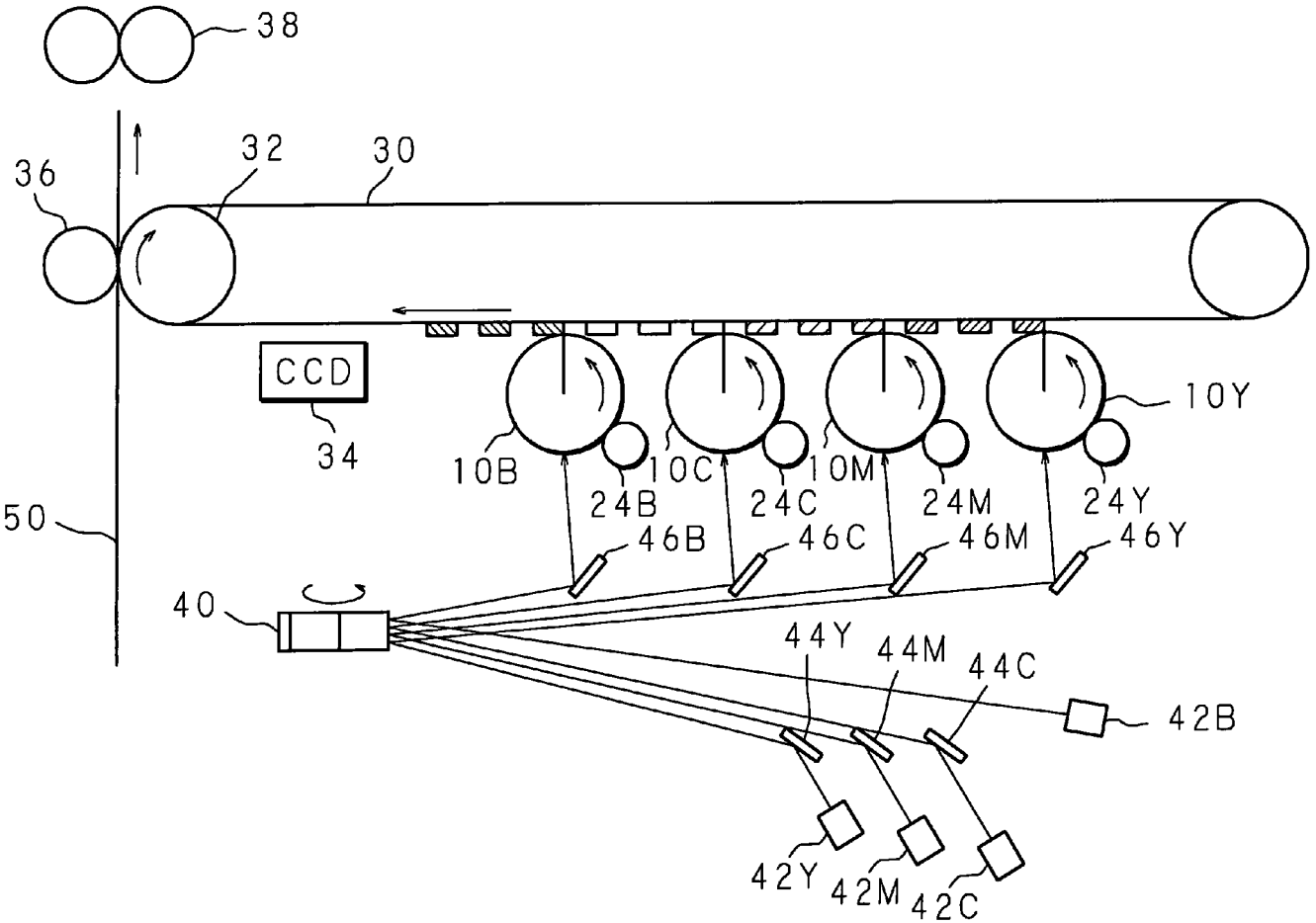
FIG. 12 is a drawing showing an example of a plurality of marks of the same color formed on a transfer belt.

Also, when adjusting the image formation timing, the LSU 64 forms a plurality of marks of the same color on the transfer belt 30 according to control from the control unit 60 as shown in FIG. 12. In the example shown in FIG. 12, three marks of the same color are formed in succession on the transfer belt 30. The CCD 34 detects the position of each mark of the same color, and the control unit 60 calculates the average value of each of the detected positions. For example, the interval S1 between the reference mark and the cyan adjustment mark is taken to be the average value of the interval between the first reference mark and first cyan adjustment mark, the interval between the second reference mark and second cyan adjustment mark and the interval between the third reference mark and third cyan adjustment mark.

Figure 4:
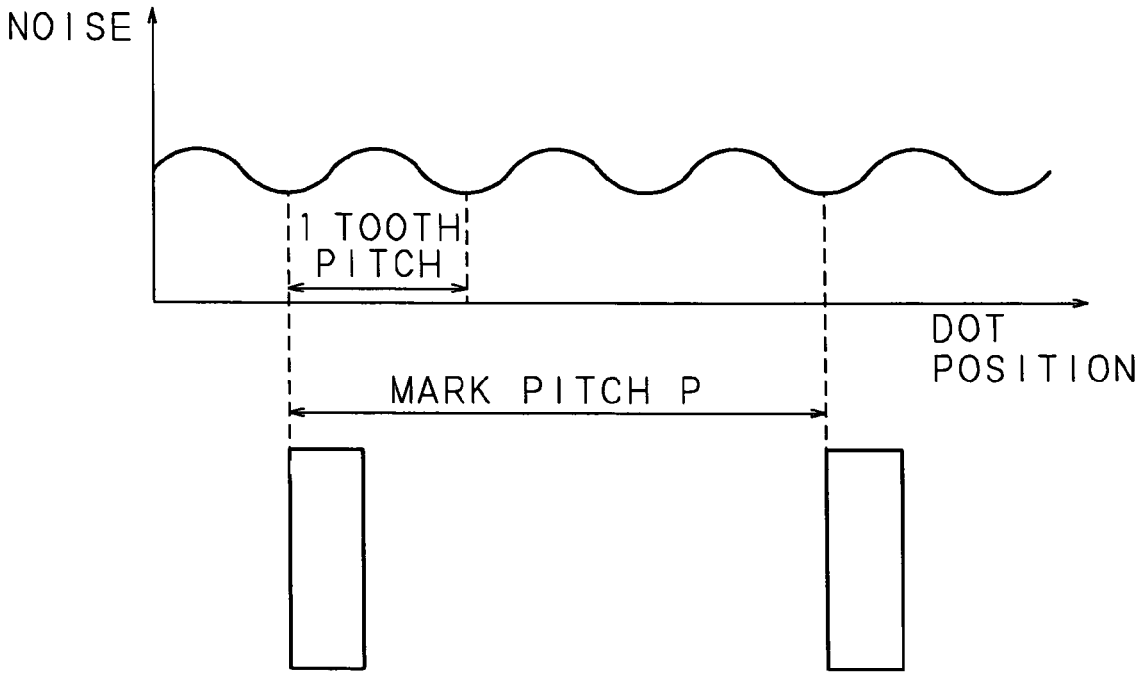
FIG. 4 is a drawing showing an example of the mark pitch.

Also, when adjusting the image formation timing, the LSU 64, according to control from the control unit 60, forms marks at a formation interval (hereafter referred to as the mark pitch) that correspond to an integral multiple of the period of a periodic noise. More specifically, the mark pitch is the interval corresponding to an integral multiple of the tooth interval of the photosensitive gear 12 (hereafter referred to as 1 tooth pitch). FIG. 4 is a drawing showing an example of the mark pitch. When the photosensitive gear 12 is engaged with the idling gear 14, noise occurs at a period of 1 tooth pitch in the transmitted torque due to effects such as tolerance and play in the tooth interval. As shown in FIG. 4, when the mark pitch P is an interval corresponding to an integral multiple of 1 tooth pitch, the noise that occurs at the front end of the mark is made to be uniform.

Figure 6:
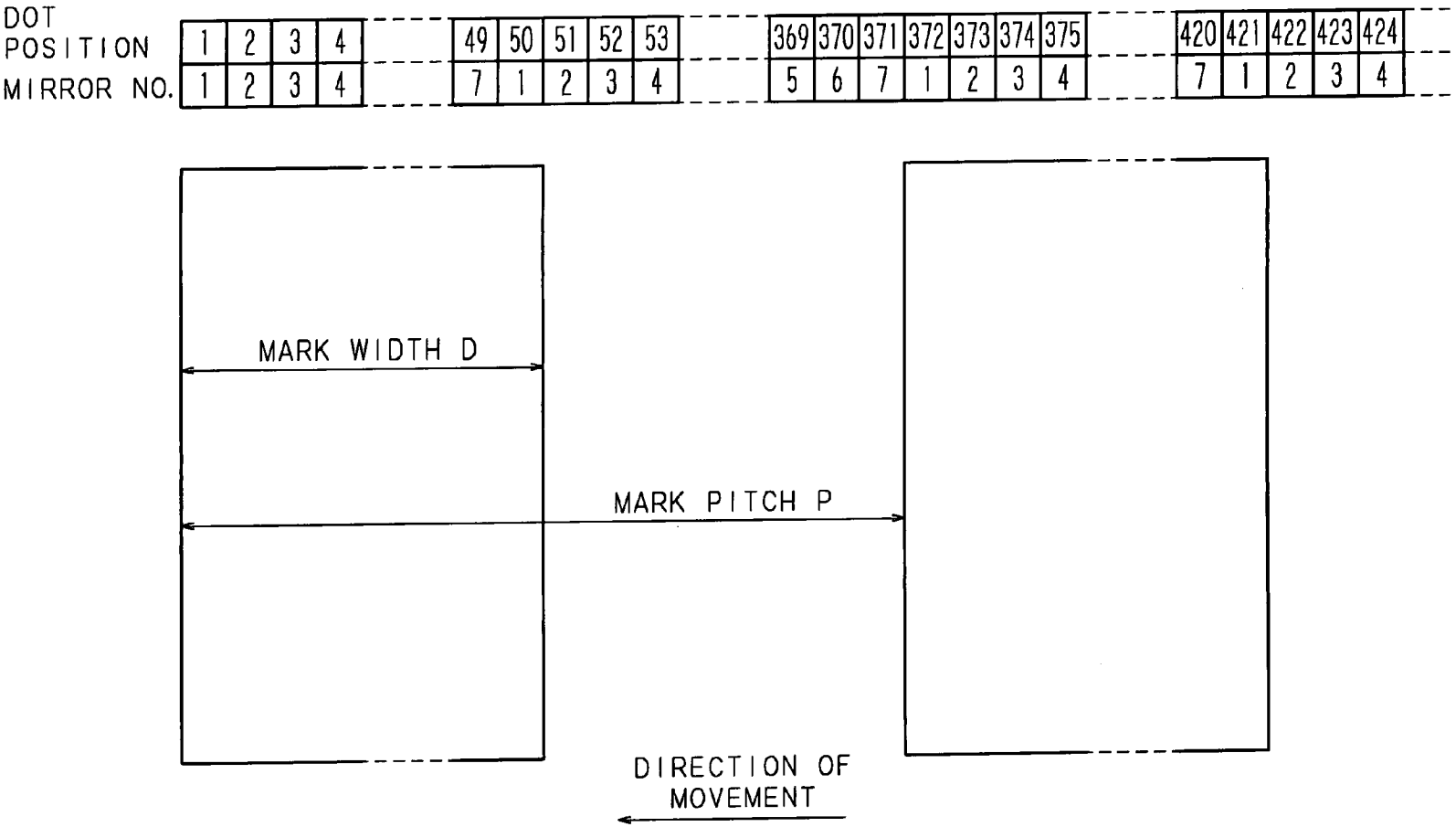
FIG. 6 is a concept drawing showing an example of mark formation.

An example of when the 1-tooth pitch of the photosensitive gear 12 is 18.55 dots will be explained below. FIG. 5A is a drawing showing an example of mark-pitch candidates. Dot intervals n×18.55 (where n is a positive integer) can be given as examples of mark-pitch candidates. Of the mark-pitch candidates, 371 dots at n=20 is an integer, so an example of the case of a mark pitch that is 371 dots will be explained. FIG. 6 is a concept drawing showing an example of mark formation. In FIG. 6, 1 is the position of the starting dot of the mark that is formed first. The second mark is formed at a mark pitch of P=371 with respect to the first mark, and the position of the starting dot is 372.

Also, when adjusting the image formation timing, the LSU 64, according to control from the control unit 60, for color-component images having a length in the formation-interval direction (movement direction) (hereafter referred to as the mark width) that corresponds to integral multiple of the number of surfaces of the polygon mirror+1. An example in which the number of surfaces of the polygon mirror 40 is 7 will be explained. In FIG. 6, the mark width D is 50 (=7×7+1) dots, and when the mirror No. that corresponds to the front end of the first mark is 1, then the mirror No. that corresponds to the rear end is also 1. Similarly, the mirror Nos. that correspond to the front and rear ends of the second mark are also 1.

Figure 7:
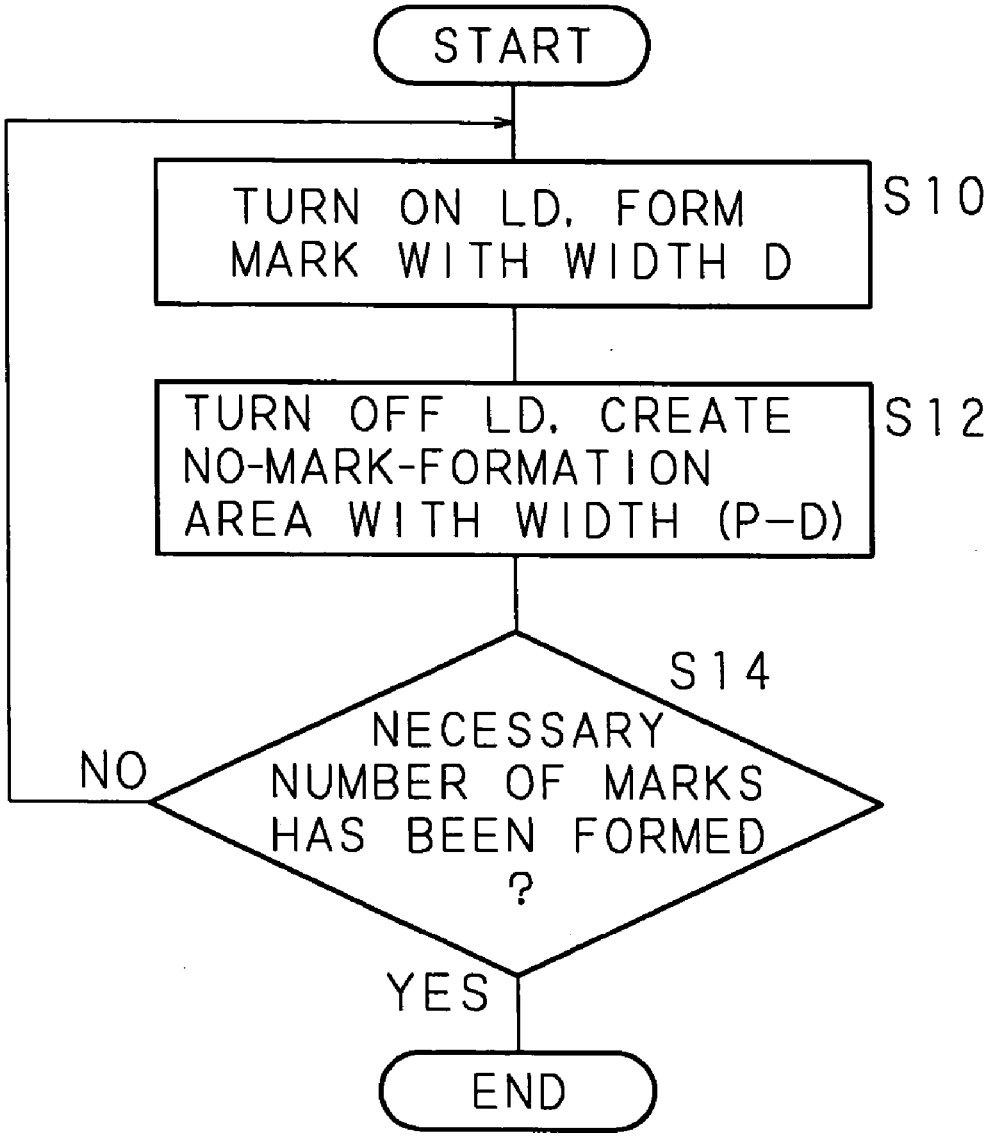
FIG. 7 is a flowchart showing an example of the mark formation procedure.

The values of the mark width D and mark pitch P described above (D=50 dots, P=371 dots) are stored in ROM 70. FIG. 7 is a flowchart showing an example of the formation procedure for forming marks. For example, when forming the black marks, according to control from the control unit 60, the laser diode 42B is turned ON and a mark having width D is formed (S10), then, the laser diode 42B is turned OFF and an area having a width (P−D) in which no marks are formed is created (S12). Next, when the necessary number of marks has not yet been formed (S14: NO), according to control from the control unit 60, the same steps are performed again (S10, S12). When the necessary number (for example 33) of marks has been formed (S14: Yes), mark formation ends. Formation of cyan, magenta and yellow marks is performed in the same way.

The control unit 60 detects the front-end position and rear-end position of each of the color-component marks from the images on the surface of the transfer belt 30 that are sent from the CCD 34, and calculates the center position of the marks and stores it in RAM 68. The control unit 60 detects the positions of the adjustment marks (cyan, magenta, yellow) based on the center position of the reference mark (black) and stores them in RAM 68, and adjusts the image formation timing so that, of the adjustment colors, when the difference between the detected position and the specified position of a color component is greater than a specified value, it does away with that difference.

In the embodiment described above, an example in which the mark pitch is an integral multiple (371=18.55×20) of 1 tooth pitch (18.55 dots) is explained, however, as shown in FIG. 5A, there are also many cases in which the mark pitch is not an integral multiple of 1 tooth pitch. Moreover, when the mark pitch is wide, there is sometimes a problem in that it takes time to form the necessary number of marks. Therefore, by periodically changing the mark pitch, it is possible to handle cases in which the mark pitch is not an integral multiple of 1 tooth pitch.

An example from FIG. 5A in which n=4 and the mark pitch is 74.2 dots will be explained below. Here, the construction of the image formation apparatus is the same as in the embodiment described above (see FIG. 1 and FIG. 2). However, the LSU (image formation means) 64, according to control from the control unit 60, changes the mark pitch (formation interval) after each specified period. More specifically, the first mark pitch Pa and second mark pitch Pb are set, and normal mark formation is performed using the first mark pitch Pa, and after each specified period, mark formation is performed at the second mark pitch Pb instead of the first mark pitch Pa. The first mark pitch Pa, second mark pitch Pb and specified period are stored in ROM 70.

In this embodiment, as shown in the concept drawing of FIG. 5B of another example of mark formation, the first mark pitch Pa is taken to be 74 dots, the second mark pitch Pb is taken to be 75 dots and the period is taken to be 5. In this case, after forming 5 marks, $$74\times4+75=371=74.2\times5$$

so this is the same as when forming marks at a mark pitch of 74.2 dots, and no error occurs.

Figure 8:
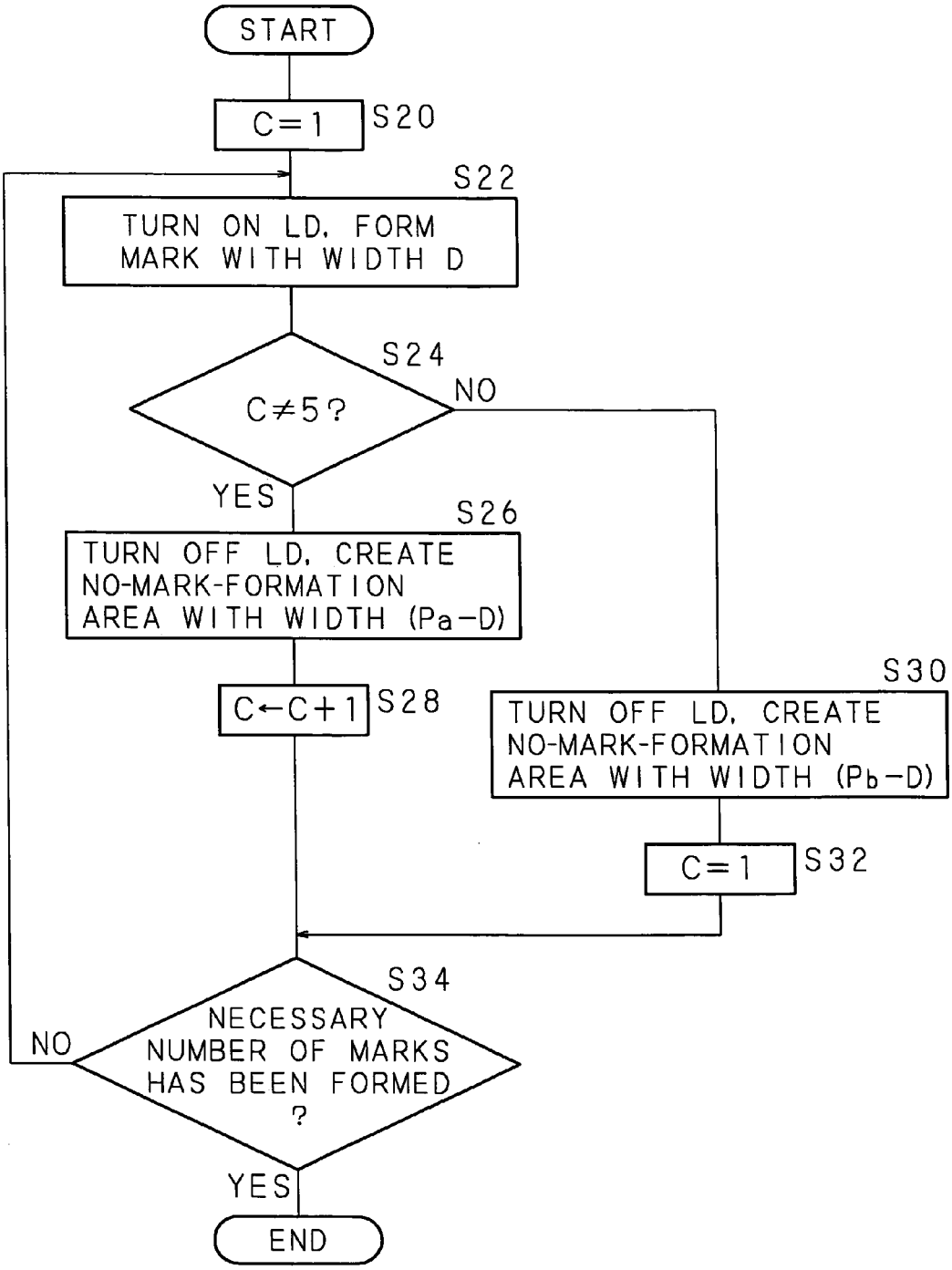
FIG. 8 is a flowchart showing another example of the mark formation procedure.

FIG. 8 is a flowchart showing another example of the procedure for forming marks. The control unit 60 updates the variable C for the period stored in RAM 68 to 1 (S20). For example, when forming black marks, according to control from the control unit 60, the laser diode 42B is turned ON, and a mark having a width D is formed (S22), then, when C is not 5 (S24: Yes), according to control from the control unit 60, the laser diode 42B is turned OFF, and an area having a width (Pa−D) in which marks are not formed is created (S26), and 1 is added to C (S28). When C is 5 (S24: No), according to control from the control unit 60, the laser diode 42B is turned OFF and an area having a width (Pb−D) in which marks are not formed is created (S30), and C is updated to 1 (S32).

After that, when the necessary number (for example 33) of marks has not yet been formed (S34: No), according to control from the control unit 60, the same steps are performed (S22 to S32). When the necessary number (for example 33) of marks has been formed (S34: Yes), mark formation ends. Mark formation of the other cyan, magenta and yellow marks is performed in the same way.

Figure 9:
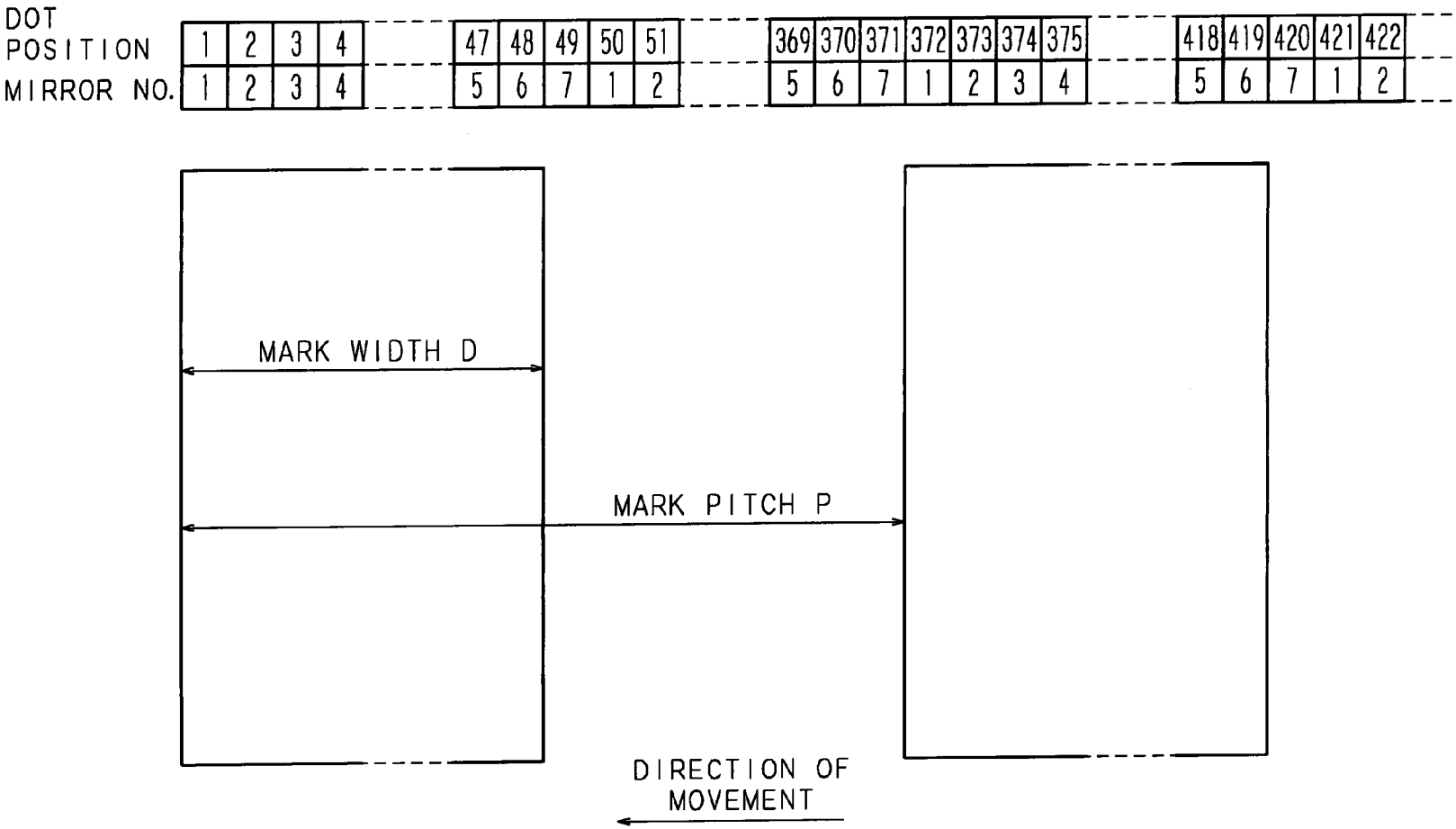
FIG. 9 is a concept drawing showing another example of mark formation.

In each of the embodiments described above, the dot positions of the front and rear ends of the marks are detected and the average is found, however, it is also possible to detect just the front end of the mark. In this case, it is not necessary to detect the dot position of the rear end, so as shown in the concept drawing of FIG. 9 that shows another example of mark formation, it is not necessary to match the mark width D with an interval corresponding to an integral multiple of the number of surfaces of the polygon mirror 40+1.

Moreover, in each of the embodiments described above, an example in which 1 tooth pitch of the photosensitive gear 12 is taken to be the period of periodic noise is explained, however, due to individual differences of each of the surfaces of the polygon mirror 40, for example, periodic noise may occur at an interval that corresponds to the number of surfaces of the polygon mirror 40. Therefore, it is also possible to use an interval that corresponds to an integral multiple of the number of surfaces of the polygon mirror as the mark pitch (formation interval).

Figure 10:
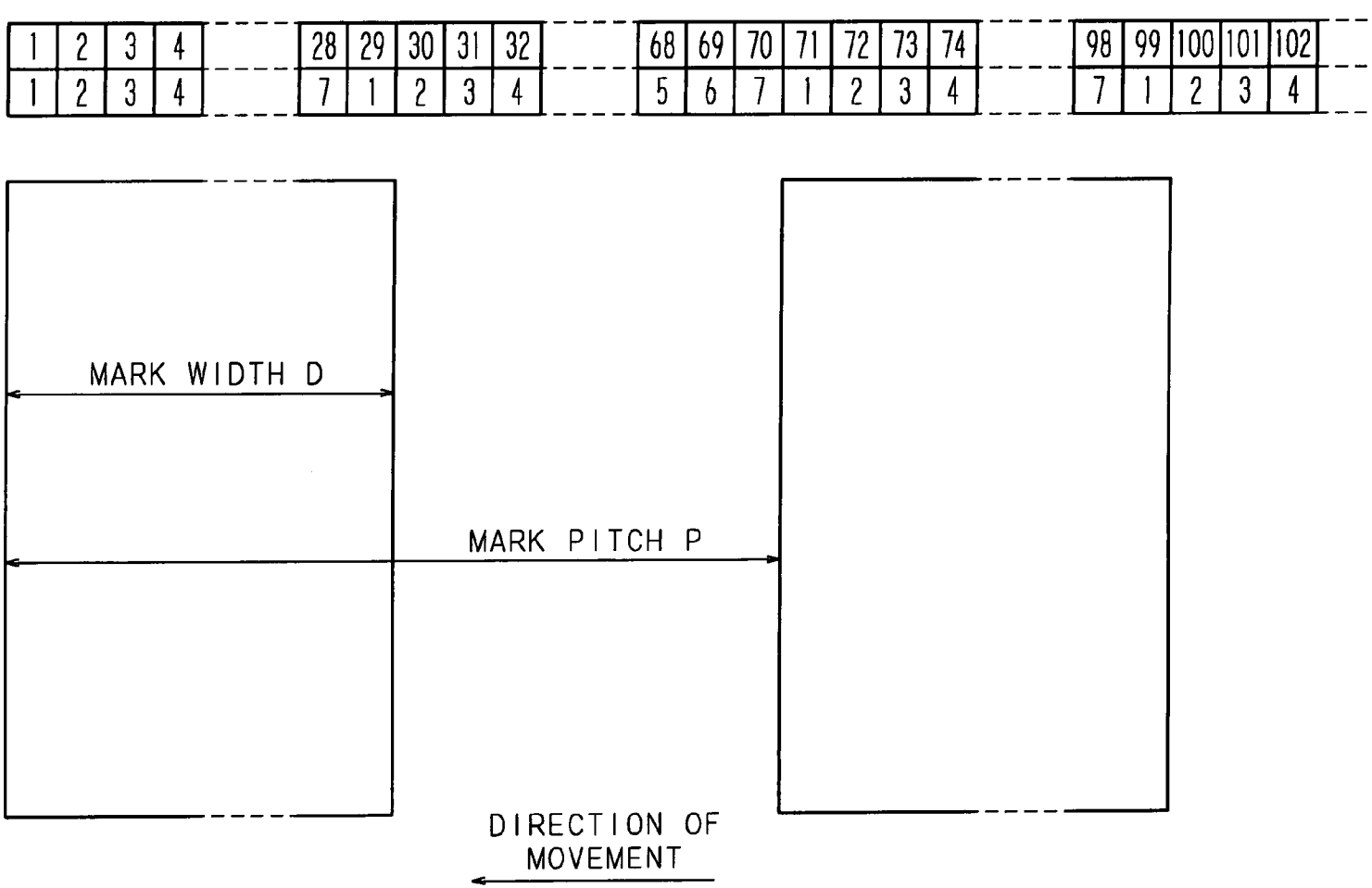
FIG. 10 is a concept drawing showing yet another example of mark formation.
Figure 11:
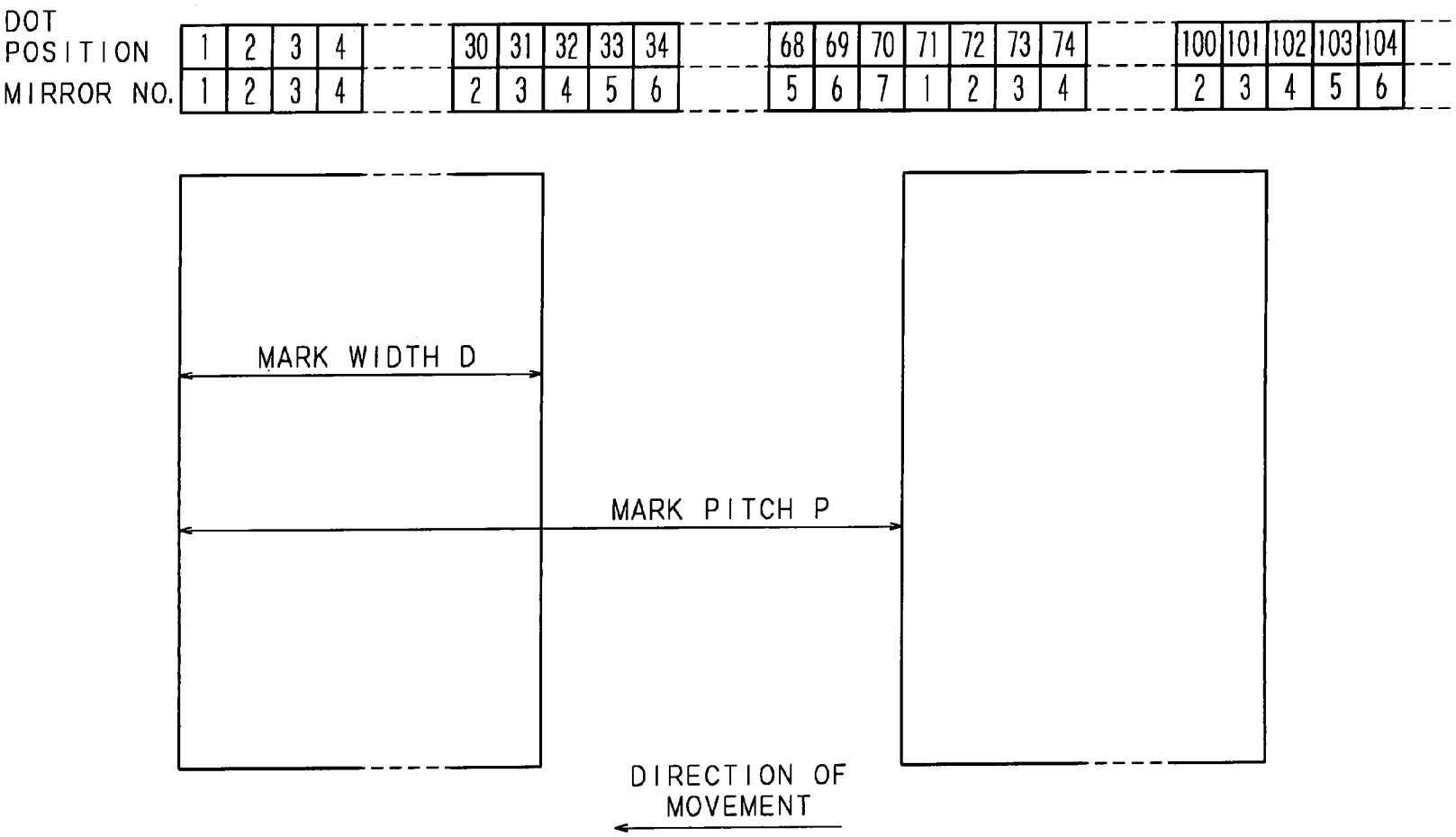
FIG. 11 is a concept drawing showing even yet another example of mark formation.

FIG. 10 is a concept diagram showing yet another example of mark formation. In FIG. 10, the mark pitch P is 70 dots, which corresponds to 10× the number of surfaces (7 surfaces) of the polygon mirror 40. Also, the mark width D is 29 dots, which is 4× the number of surfaces (7 surfaces) of the polygon mirror+1. When detecting just the front end of the mark, it is not necessary to detect the dot position of the rear end, so as shown in the concept drawing of FIG. 11 that shows even yet another example of mark formation, it is not necessary to match the mark width D with an interval that corresponds to an integral multiple of the number of surfaces (7 surfaces) of the polygon mirror+1.

In each of the embodiments described above, examples in which 1 tooth pitch of the photosensitive gear 12 or the number of surfaces of the polygon mirror 40 is taken to be the period of periodic noise are explained, however, it is also possible to combine the two, and to make the mark pitch be an interval that corresponds to both an integral multiple of the tooth interval of the photosensitive gear 12, and an integral multiple of the number of surfaces of the polygon mirror 40. For example, when 1 tooth pitch of the photosensitive gear 12 is 18.55 dots, and the number of surfaces of the polygon mirror 40 is 7, it is possible to make the mark pitch be 371 (=18.55×20=7×53).

Also, there are cases in which the noise that occurs in a one-rotation period of the motor gear 16 corresponds with one rotation of the motor's rotating shaft. For example, when the pitch of 15 teeth of the photosensitive gear 12 corresponds to 1 rotation of the motor gear 16, the mark pitch can be made to be an interval that corresponds to the integral multiple 278.25 (=18.55×15).

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image formation apparatus, comprising:

an image formation unit that forms color-component images that correspond to a plurality of color components onto a plurality of corresponding image-carrying bodies respectively;

a transfer medium onto which the respective color-component images that are formed on said image-carrying bodies are transferred, the transfer medium facing said respective image-carrying bodies and moving in the same direction as a movement direction of the respective image-carrying bodies; and a position detection unit that detects positions of the respective color-component images that are transferred onto said transfer medium, said image forming apparatus further adjusting an image formation timing based on the positions, detected by the position detection unit, of said respective color-component images, wherein said image-carrying bodies are photosensitive drums, said image formation unit comprises one polygon mirror and an irradiation unit that irradiates a plurality of light beams that correspond to said respective color-components onto the same reflection surface of the polygon mirror, said respective light beams reflected by said polygon mirror being irradiated onto said respective photosensitive drums, said image formation unit forms the color-component images each having a length in a movement direction of each of the photosensitive drums that corresponds to an integral multiple of the number of surfaces of the polygon mirror+1 when the image formation timing is adjusted, said detection unit detects an average position between a front end position and a rear end position in a length direction of each of said respective color-component images as a position of each of said color-component images, and said formation timing of each of said color-component images to be adjusted is adjusted so that an interval between the color-component image to be a reference having the position detected by said position detecting unit and the color-component image to be adjusted is a predetermined interval.

2. The image formation apparatus of claim 1, wherein said image formation unit forms said respective color-component images onto said respective photosensitive drums at the same timing when said image formation timing is adjusted.

3. The image formation apparatus of claim 1 wherein when said image formation timing is adjusted, said image formation unit forms a plurality of images as said color-component images at formation intervals that correspond to an integral multiple of a period of a periodic noise, and an average value of intervals between corresponding images, said images being comprised of a plurality of images of the color-component image to be adjusted, is taken as an interval between the color-component image to be the reference and the color-component image to be adjusted.

4. The image formation apparatus of claim 3, wherein said formation interval is an interval corresponding to an integral multiple of the number of said surfaces of said polygon mirror.

5. The image forming apparatus of claim 3, wherein said photosensitive drums comprise gears to which a rotational movement is transferred, and said formation interval is an interval corresponding to an integral multiple of a tooth interval of said gears.

6. The image forming apparatus of claim 5, wherein said formation interval is an interval corresponding to both the integral multiple of the tooth interval of said gears and the integral multiple of the number of surfaces of said polygon mirror.

7. The image formation apparatus of claim 3, wherein said image formation unit changes said formation interval after each specified period.

* * * * *